United States Patent [19]

Kosrow et al.

[11] Patent Number: 4,519,331

[45] Date of Patent: May 28, 1985

[54] APPARATUS FOR TRANSFERING AND STACKING SHORT WORKPIECE PANELS

[75] Inventors: Robert L. Kosrow, Hoffmann Estates; Robert C. Talsma, Glen Ellyn, both of Ill.

[73] Assignee: Union Special Corporation, Chicago, Ill.

[21] Appl. No.: 603,878

[22] Filed: Apr. 25, 1984

[51] Int. Cl.[3] ..... D05B 33/00

[52] U.S. Cl. ..... 112/262.3; 112/121.29; 271/184

[58] Field of Search ..... 112/121.29, 121.15, 112/262.3, 262.1; 271/184, 225

[56] References Cited

U.S. PATENT DOCUMENTS

| | | | |
|---|---|---|---|
| 3,620,525 | 11/1971 | Hawley | 112/121.29 X |
| 3,966,188 | 6/1976 | Maguire | 271/184 X |
| 3,994,487 | 11/1976 | Wicklund | 271/184 X |
| 4,111,137 | 9/1978 | Kirby | 112/121.29 X |
| 4,203,694 | 5/1980 | James | 271/184 X |
| 4,307,675 | 12/1981 | Ott et al. | 112/121.29 |
| 4,445,679 | 5/1984 | Bay | 271/184 X |
| 4,483,530 | 11/1984 | Spencer et al. | 271/184 X |

OTHER PUBLICATIONS

Union Special Automated Systems, Catalog No. 500A, Pub. Apr., 1974, by Union Special Corp.

*Primary Examiner*—H. Hampton Hunter

*Attorney, Agent, or Firm*—John W. Harbst; John A. Schaerli

[57] ABSTRACT

A mechanism for transfering workpieces received from an automatic sewing machine and stacking same at a location remote from the machine. The mechanism includes a pivotally arranged stacker device that is movable toward and away from the sewing machine. The stacker device includes a rotational work supporting surface against which the workpiece exiting from the machine is releasably held. The stacker device also includes a mechanism for orientating the workpiece in a predetermined disposition on the work supporting surface of the stacker device during transferance to insure proper workpiece stacking.

18 Claims, 7 Drawing Figures

FIG. 4
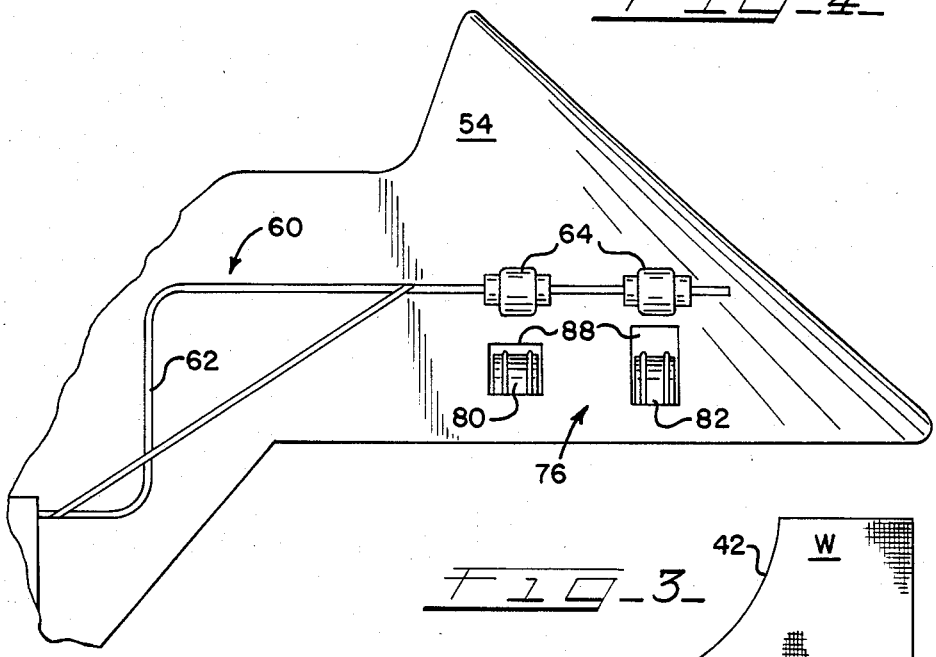
FIG. 3
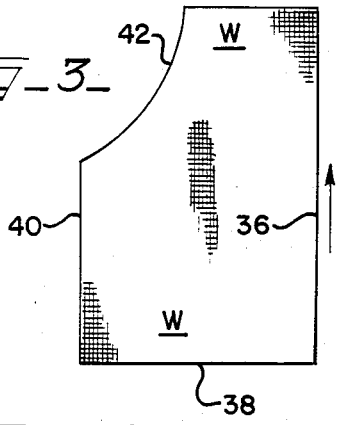
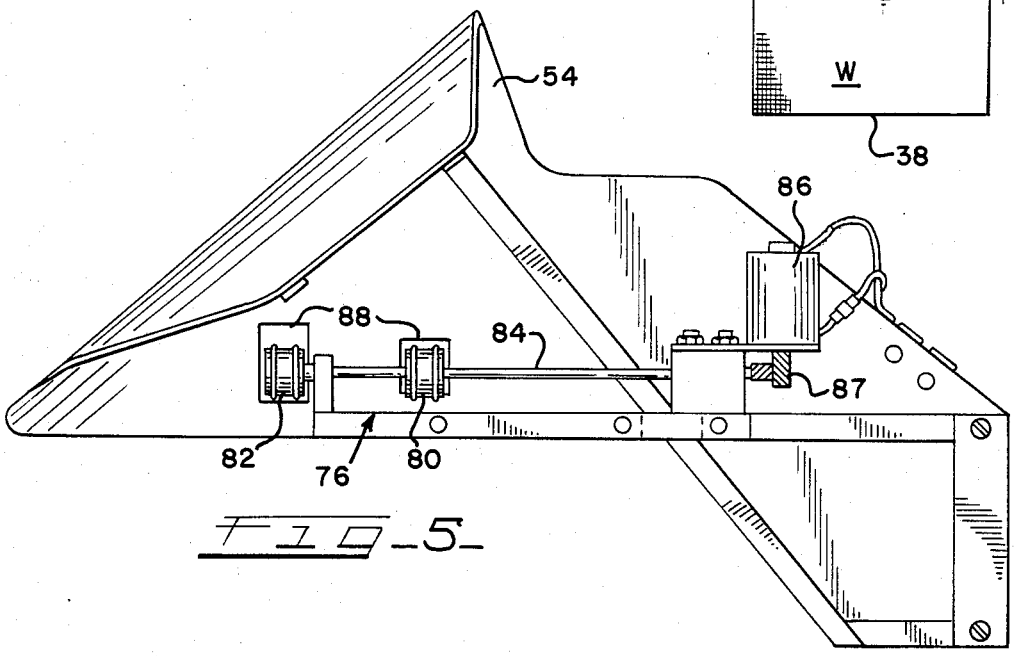
FIG. 5

APPARATUS FOR TRANSFERING AND STACKING SHORT WORKPIECE PANELS

FIELD OF THE INVENTION

This invention generally relates to sewing machines and, more particularly, to a workpiece handling apparatus for stacking short workpiece panels received from an automatic sewing machine.

BACKGROUND OF THE INVENTION

Serging of pants panels is a well-known operation in the garment industry. On regular pants panels, the length of the garment or workpiece overhanging the work supporting surface of the machine is sufficient to permit efficient stacking of the panels after the serging operation has been completed. When short panels are to be serged or sewn, however, problems in stacking of the sewn workpieces result because of the shortened workpiece length. The shortened length of the panel presents a problem because an insufficient amount or length of workpiece panel overlies the machine work support to allow stacking of same.

SUMMARY OF THE INVENTION

Because of the above, and in accordance with the present invention, there is provided a stacker mechanism which is adapted to handle both long and short workpiece panels. The apparatus of the present invention includes a stacker mechanism pivotally arranged on the sewing machine pedestal and which is responsive to the machine control system. Arranged in cooperation with the stacker mechanism is an independently driven feed roller arrangement adapted to position and hold the workpiece on the work supporting surface of the sewing machine. The stacker mechanism is adapted for pivotal movement between one position, removed from the sewing machine, and another position disposed proximate to said machine. The stacker mechanism includes a stacker shield having a work supporting plate or surface onto which the workpiece passes from said sewing machine when the stacker mechanism is arranged proximate to said machine. The disposition of the work supporting surface on the stacker changes as a function of the angular disposition of the workpiece stacker mechanism. To releasably hold the workpiece on the stacker supporting surface, a releasable clamping mechanism including a lifting and pressing mechanism means operable in response to the control system is provided. In the preferred embodiment, the clamping mechanism includes a pair of presser rollers which are movable toward and away from the stacker's supporting surface.

Interconnected with the stacker mechanism is a workpiece orientating mechanism. The orientating mechanism includes at least two independently driven feed rollers. The feed rollers cooperate with the presser rollers in holding and orientating or positioning the workpiece relative to the stacker shield. The feed rollers are driven from an independent source which is preadjusted to rotate the feed rollers as a function of workpiece size. The feed rollers act during the transferance of the workpiece to position the workpiece on the stacker means in a manner ensuring proper stacking at the deposit site.

In line with the above, a primary object of this invention is the provision of a stacker mechanism which has the capability of use with long or short workpiece panels.

Another object of this invention is the provision of a mechanism adapted to transfer short workpiece panels from a sewing machine to a position removed from the machine whereat the workpiece panels are properly stacked.

Another feature of this invention is the provision of a short workpiece stacker mechanism which may be retrofitted to existing sewing machines in the field with minimum parts and cost.

Another object of this invention is the provision of a stacker apparatus having suitable means for orientating the workpiece article thereon during the transferance process to ensure proper stacking in a remote location.

DESCRIPTION OF THE DRAWINGS

Having in mind the above objects and other attendant advantages that would be evident from an understanding of the disclosure, the invention comprises the devices, combination and arrangement of parts as illustrated in the presently preferred form of the invention which is hereinafter set forth in detail to enable those skilled in the art to readily understand the function, operation, construction and advantages of same when read in conjunction with the accompanying drawings in which:

FIG. 3 is a diagramtic view of a workpiece showing its direction of feed when initially introduced to the automatic sewing apparatus;

FIG. 4 is an enlarged rear elevational view of a portion of the stacker mechanism of the present invention;

FIG. 5 is an enlarged front elevational view of a portion of the stacker mechanism of the present invention;

DETAILED DESCRIPTION OF THE PRESENT INVENTION

Figure 1:
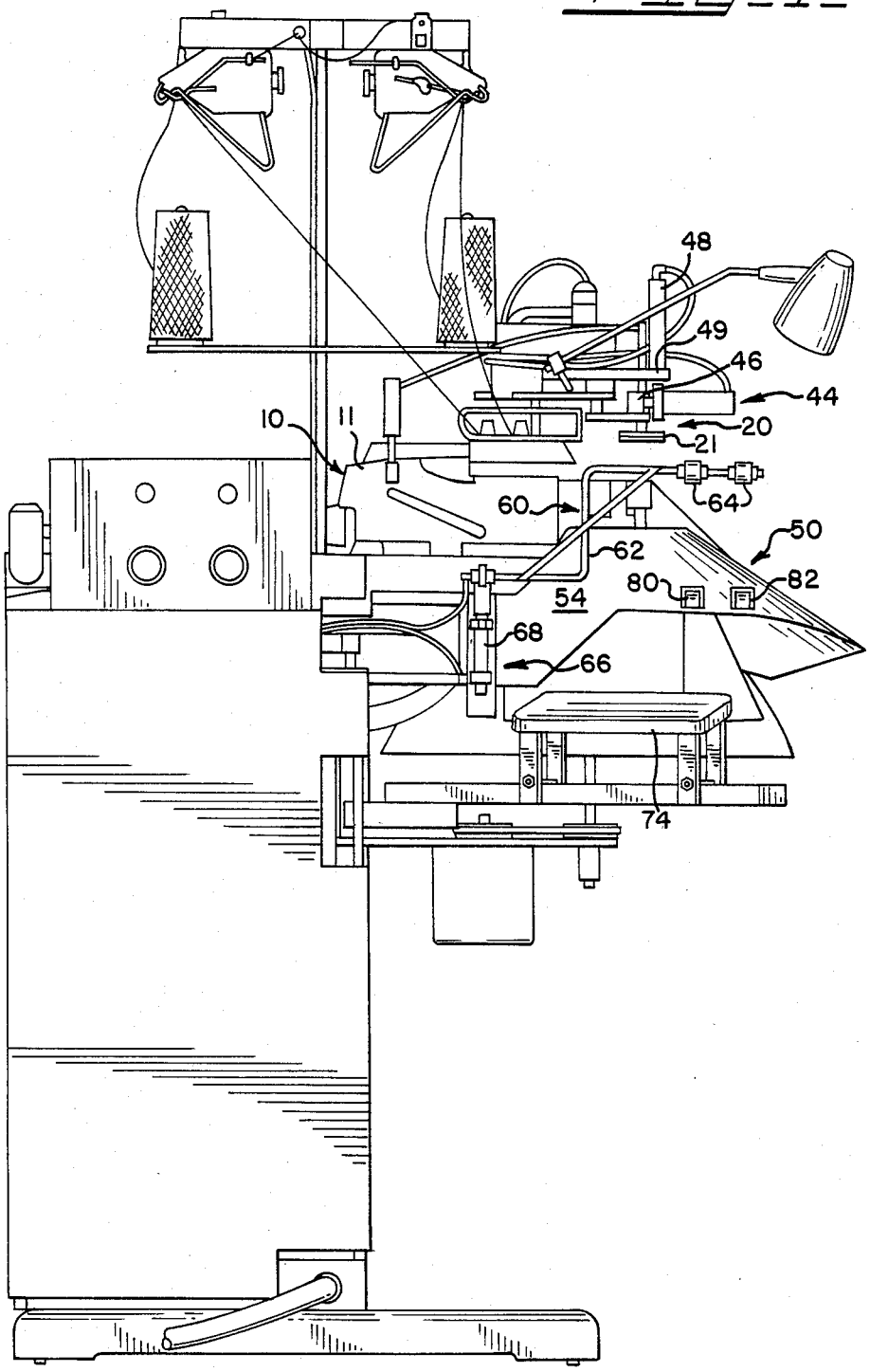
FIG. 1 is rear elevational view of an automated sewing apparatus incorporating the present invention.

Turning now to the drawings, wherein like reference numerals indicate like parts throughout the several views, in FIG. 1 there is shown a preferred embodiment of an automatic sewing apparatus. The automatic apparatus of the present invention includes a sewing means 10, workpiece turning means 20 and a workpiece stacker means 50. The system components combine to effect serging of workpiece panels having divergently extending edges.

Figure 6:
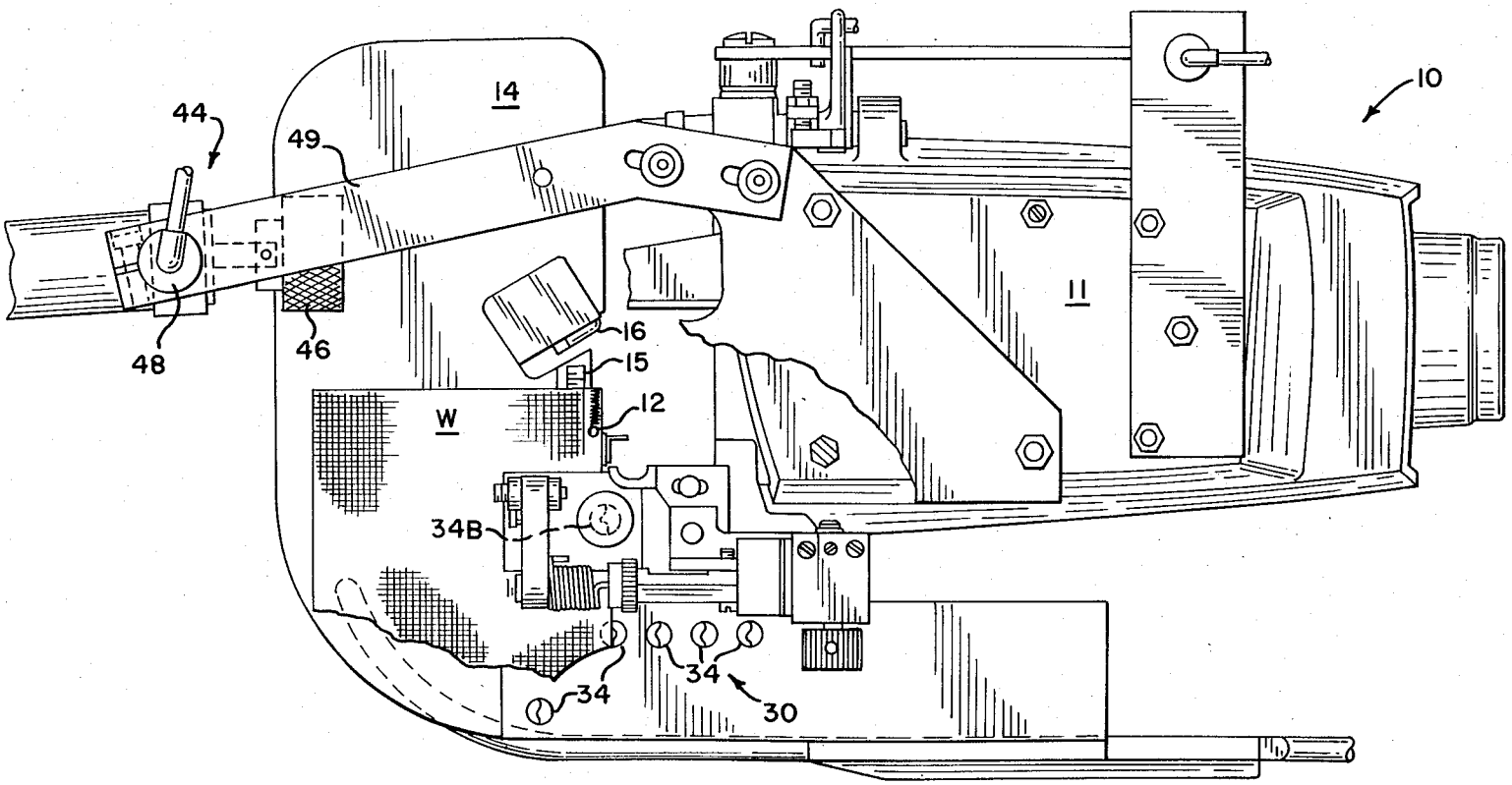
FIG. 6 is a top plan view of a portion of the sewing machine associated with the automatic sewing apparatus illustrated in FIG. 1.

The sewing means 10 of the present invention includes a pedestal mounted sewing machine 11. The machine is of the general character shown in the patent to R. L. Kosrow U.S. Pat. No. 3,425,369 granted Feb. 4, 1969 the full teachings of which are incorporated herein Suffice it to say, and as best seen in FIG. 6, the sewing machine is by reference. Suffice it to say, and as best seen in FIG. 6, the sewing machine is provided with the usual stitch forming devices or instrumentalities including needle means 12, a generally horizontal work supporting surface 14, and feeding means 15 for advancing the workpiece over the work supporting surface and past the stitching devices. Although not shown, the sewing means also includes means for positioning the sewing machine needle in or out of the workpiece depending upon the particular phase of the sewing cycle. A thread chain cutter 16 is also provided for severing the free end of the thread chain extending from the workpiece.

Figure 2:
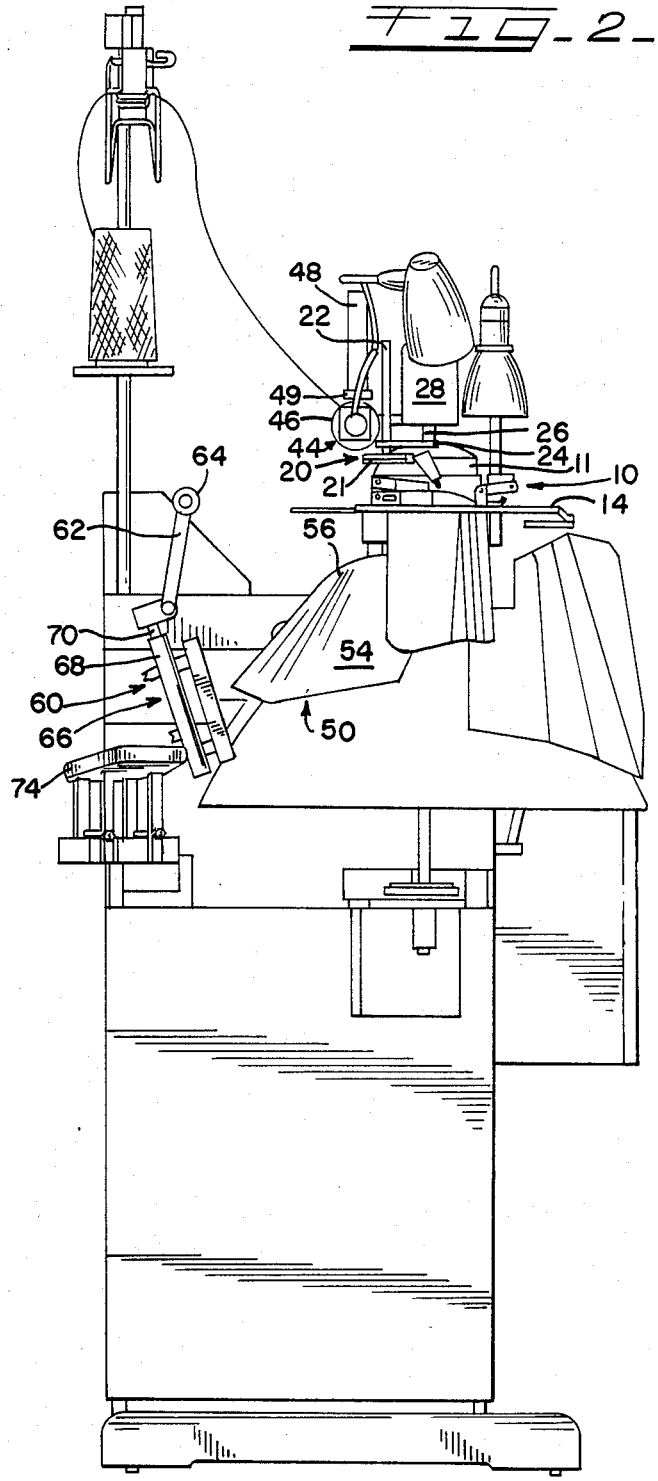
FIG. 2 is a side elevational view of the automated sewing apparatus illustrated in FIG. 1.
Figure 7:
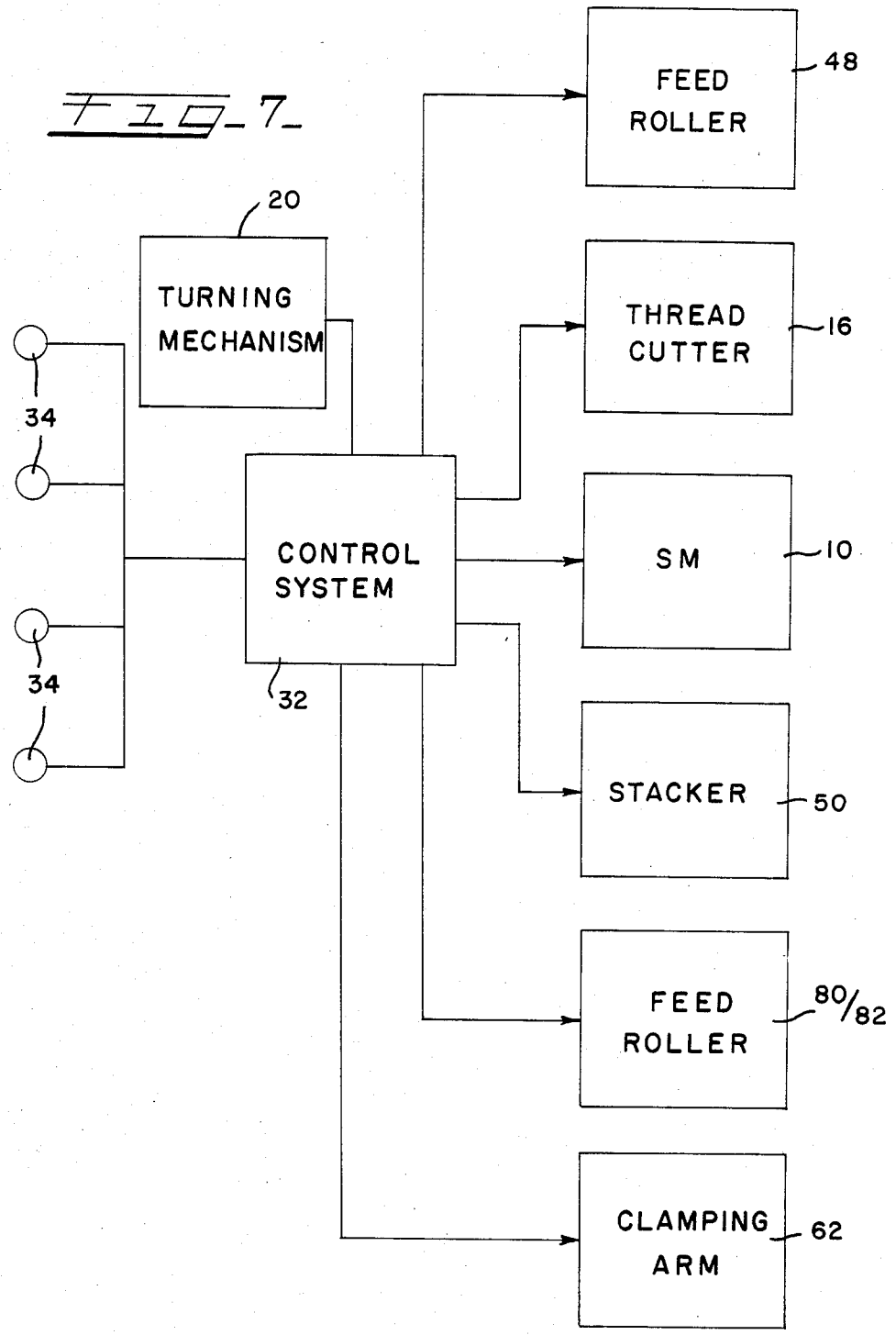
FIG. 7 is a schematic block diagram of various components comprising the present invention.

As mentioned above, the present invention is used with an automatic apparatus for sewing or serging divergently extending edges of workpiece panels as shown in FIG. 3. As such, the automatic apparatus includes a workpiece turning means 20 which, as its name implies, automatically turns the workpiece through a suitable angle, such as 90° upon completion of the stitching of one edge of the fabric panel to bring another edge of the workpiece into position for being advanced and stitched. To accomplish this end, and as best seen in FIG. 2, the turning means includes a workpiece engaging member 21 which is adapted for reciprocal movement toward and away from the work supporting surface 14 of the machine. To effect such reciprocal movement, the member 20 is carried at the driven end of a pneumatic cylinder 22. The pneumatic cylinder and thereby member 20 are mounted at the free end of an arm 24 whose other end is secured to a depending shaft 26 of a drive motor 28. The drive motor 28 serves to rotate the arm 24 and thereby the member 20. The actuation of the cylinder 22 and drive motor 28 is controlled by a series of workpiece monitoring means 30 (FIG. 6) which comprise a portion of and which deliver signals to a control system 32 (FIG. 7). The control system 32 may be of the type disclosed in the above-identified Kosrow patent or one similarly suited. In the preferred embodiment, the monitoring means include a series of photosensitive devices 34 positionally arranged in the work supporting surface of the machine at different locations. The sensors 34 monitor the position of the workpiece edge and deliver signals to the control system which, in turn, controls the motor 28 and drive cylinder 22 to cause the turning mechanism to turn the workpiece panel through an angle corresponding with that of the angular relationship between adjacent edges of the workpiece. Thus, assuming that the workpiece W is of the configuration shown in FIG. 3, the turning mechanism will serve to turn the workpiece through an angle of 90° upon completion of the stitching a workpiece edge 36 as the workpiece is fed in the direction indicated by the arrow. Such turning will serve to bring the adjacent edge 38 into the line of feed with this newly positioned edge then being subjected to the application of a line of stitching. Upon completion of the stitching edge 38, the turning mechanism will again be brought into play to turn the workpiece through another angle of 90° thus placing the adjacent workpiece edge 40 in position of the application of the next line of stitching. Understandably, if the sharp angles provided in the workpiece are other than 90° as with edge 42, the turning mechanism will be so controlled as to turn the workpiece through the desired angle to bring the adjacent edge into the line of stitching formation.

An auxiliary turning or positioning mechanism 44 which is operable in response to the control system is also provided on the apparatus. As may be seen in FIGS. 1, 2 and 5, the auxiliary turning mechanism includes a rotatably driven feed wheel or a roller means 46 which is vertically movable toward and away from the work supporting surface 14 of the machine. The feed wheel means 46 is carried at the driven end of a pneumatic cylinder means 48 which serves to vertically position the feed wheel relative to the work supporting surface of the sewing machine. The pneumatic cylinder 48 and thereby feed wheel means 46 are arranged above the work supporting surface at the free end of a cantilevered support bracket 49 which is adjustably mounted to the sewing machine 10. When the feed roller means is in its operative position, it provides a force on the top of the workpiece panel. The peripheral speed of the feed roller means 46 is adjustable and turns faster than the advance rate imparted to the workpiece by the feed mechanism means of the sewing machine. Since the peripheral speed of the feed roller may be adjusted to an advance rate faster than the advance rate of the workpiece and since the workpiece basically has a pivot point when the sewing machine is effecting stitching thereof, the panel is moved about the pivot point and the desired arcuate seam may be automatically formed in the curved edge 42 (FIG. 3) of the workpiece. To avoid material handling problems, it has been found desirable to begin rotation of the feed wheel 46 immediately preceding the contact of the feed wheel with the top of the workpiece panel.

The stacking means or mechanism 50 will now be described. In the preferred embodiment, the stacker or workpiece transfer means includes a shield 54 having a work supporting plate or surface 56 onto which the workpiece passes upon exiting from the sewing machine. The stacker mechanism is pivotally mounted to the sewing machine pedestal and is adapted for generally horizontal movement toward and away from the sewing machine in response to signals from the control system 32. Preferably, the control system actuates the stacker shield 54 to move from a position remote from the sewing machine toward the position shown in FIGS. 1 and 2 upon completion of the serging operation on edge 38 of the workpiece. When in the position shown in FIG. 2, the workpiece exits the sewing machine and passes over the work supporting surface 56 of the stacker.

Arranged in combination with the stacker means is a workpiece holding mechanism means 60. The clamp or holding mechanism is carried by the stacker shield 54 and includes a revoluable clamping rod 62 having two or more clamp rollers 64 carried thereon. The clamping rod 62 with the clamping rollers 64 is movable toward and away from the supporting surface of the stacker shield under the influence of a lifting and pressing mechanism 66. The lifting and pressing mechanism 66 includes a pneumatic driver 68 whose operative end 70 is operatively associated with the clamping rod 62. Like the other components of this automated system, the cylinder or driver 68 is controllably operated by or responsive to the control system 32. The clamping rollers 64 serve to releasably hold the workpiece during its transferance from the sewing machine to the point at which the workpiece is to be stacked.

Upon completion of the serging operation, the stacker means moves away from the sewing machine. The stacker shield is mounted such that the disposition of the work supporting plate or surface 56 changes as a function of the pivotal position of the stacker means. That is, as the shield moves toward a second position outwardly away from the machine the supporting plate or surface is simultaneously rotated about an axis extending substantially parallel with the work supporting surface of the machine. Upon reaching its second position, the clamping arm 62 is raised and the workpiece is deposited or stacked on a work support means 74. The work support means 74 is spaced from the work supporting surface 14 of the machine in a non-parallel relationship at a lower second generally horizontal level.

The stacker mechanism of the present invention is further supplemented with the device for overcoming the problems encountered with short pants panels and which ensures proper placement of the workpiece panel on the work supporting means 74. To accomplish these ends, a workpiece orientating means 76 is operative associated with the stacking mechanism. In the presently preferred embodiment, best seen in FIGS. 4 and 5, the workpiece orientating means 76 includes a feeding device having at least two driven feed rollers 80 and 82. The feed rollers are coaxially arranged in a spaced relationship at one end of a drive shaft 84 revolubly mounted to the underside of the stacker shield 54. The other end of the revoluble drive shaft 84 is operatively associated with a drive motor 86 that serves to impart rotation to the wheels 80 and 82. Preferably, the drive motor and drive shaft are operatively connected through a worm gear type connection 87. A portion of each feed roller penetrates suitably formed apertures or recesses 88 provided on the shield 54. As should be apparent from FIGS. 2 and 4, the presser rollers 64 are adapted to be moved into a cooperative relationship with the feed rollers in a manner whereby situating a workpiece panel therebetween.

In operation, the machine operator initially locates a workpiece relative to the sewing machine 10. The sensors or monitoring means 34 detect such and deliver appropriate signals to the control circuitry or system 32 of the machine. The control system thereafter automatically controls the machine operation. That is, the first side or edge 36 of the fabric panel is serged or sewn. After the first sewing cycle or serging operation has been completed, the sewing machine is stopped with its needle down in the trailing edge of the line of stitching that has been completed. Thereafter, the turning mechanism 20 serves to automatically turn the workpiece about the needle to bring the second edge 38 into the line of feed. Having once adequately turned the workpiece, the second workpiece edge 38 is presented to the sewing station of the machine. After two sides of the workpiece panel have been finished, the control system 32 signals the stacker mechanism 50 to move the shield 54 from its removed position to the position shown in FIGS. 1 and 2. Upon sewn completion of the second edge 38, the material panel is again automatically turned with the sewing needle in the work to present the third edge 40 of the workpiece to the stitching mechanism. The third edge of the workpiece is sewn until the photocell 34B (FIG. 6) is uncovered. Once the photocell is uncovered, the puller or feed wheel 46 begins to descend turning several revolutions before contacting the garment.

Assuming that short panels are being worked on, the workpiece may not extend over the work supporting surface of the machine 14 to a sufficient degree to prevent proper stacking. Accordingly, the unique features of the present invention begin their function. The puller or feed wheel 46 contacts the top of the workpiece and continues to turn for a predetermined period of time. The action of the feed wheel 46 has the effect of moving or positioning the workpiece panel toward the stacker means 50 while simultaneously holding same to prevent the panel from dropping to the floor. Next, the chain cutter 16 is operated according to a time delay signal received from the control system. Because of the action of the feed wheel 46, the workpiece panel passes over the work supporting surface 56 of the stacker shield 54 between the feed rollers 80 and 82 of the workpiece orientating means 76 and the clamping or pressing rollers 64. The lifting and pressing mechanism 66 is then actuated whereby moving the presser rollers into contact with the workpiece to press the later against the feed rollers 80 and 82. The puller or feed wheel 46 is upwardly retracted out of contact with the workpiece whereby allowing the stacker mechanism to move to its second position. As the stacker shield 54 retracts to the second position, the control system activates the drive motor 86 whereby rotating the feed rollers 80 and 82 whereby orientating and positioning the workpiece relative to the stacker shield. Having once transferred the workpiece to the second position whereat the stacker is arranged over the work supporting means 74, the lifting and pressing mechanism 66 releases the clamping rollers 64 from their operative relationship with the rollers 80 and 82 whereby allowing placement of the workpiece panel on the work supporting means 74.

It will be understood that while the apparatus has been described to impart only two turns to the workpiece to thus enabling the stitching of three sides or edges of the workpiece, the described automated apparatus is readily able to also serge or sew the fourth edge 42 of the workpiece. Such is accomplished by first presenting the arcuate edge 42 of the workpiece to the stitching instrumentalities of the machine whereby effecting proper stitching and then turning the workpiece sequentially through the three corners thus presenting the remaining three edges, i.e. 40, 38 and 36, as previously described. The remaining functions of the automated sytem, i.e. the clamping and orientating of the workpiece relative to the stacker during its transferance would remain substantially the same in operation.

Thus there has been provided an Apparatus for Transfering and Stacking Short Workpiece Panels that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modications, and variations as fall within the spirit and broad scope of the appended claims.

Having described our invention, what we claim is:

1. A method of serging divergent edges of a workpiece with an automatic apparatus including an automatically controlled sewing machine having a work supporting surface, a stacking apparatus, said method comprising the steps of:

automatically serging the edges of the workpiece with said sewing machine;

moving the stacking apparatus to a first position to receive the serged workpiece from the work supporting surface of the machine prior to completion of the serging operation;

holding the serged workpiece against the stacking apparatus;

moving the stacking apparatus to a second position while simultaneously positioning the workpiece relative to the stacking apparatus; and releasing the workpiece from the stacking apparatus.

2. A method as recited in claim 1 comprising the further step of positioning the sewn workpiece on the work supporting surface after the last work edge has been sewn and releasably holding same thereagainst until the workpiece is removed by said stacking apparatus.

3. In combination with a pedestal mounted overedge sewing machine having a work supporting surface and stitch forming instrumentalities adapted to operate along at least three sides of a workpiece, a control system for sequentially operating said sewing machine and a stacking device comprising:

stacker means pivotally arranged on said pedestal and responsive to said control system for transfering a workpiece received from the work supporting surface of the machine to a predetermined position whereat said workpiece is deposited; and means operatively associated with said stacker means for orientating the workpiece in a predetermined disposition relative to the stacker means during its transferance to said predetermined position.

4. The invention according to claim 3 wherein said orientating means includes independently controlled motor driven feed means whereby allowing variation in the disposition of the workpiece relative to the stacker means.

5. Apparatus for automatically sewing workpieces along their divergently extending edges comprising:

a sewing machine having stitch forming instrumentalities adapted to work along the advancing edge of a workpiece and a work supporting surface disposed at a first generally horizontal level;

means for automatically controlling the operation of said sewing machine including signal producing means for sensing when the workpiece reaches a predetermined position;

pivotable stacker means responsive to said control means for transfering a workpiece exiting from said sewing machine to a work supporting means spaced from said work supporting surface and at a second generally horizontal level; and operative means for moving said workpiece relative to said stacker means during transferance of the workpiece to permit proper placement of the workpiece on said work supporing surface.

6. The invention of claim 5 wherein said stacker means includes a workpiece supporting plate onto which the workpiece passes from said sewing machine and whose disposition changes as a function of the pivotal position of said stacker means.

7. The invention according to claim 6 wherein said workpiece supporting plate is provided with apertures and said operative means includes rotatable feed rollers penetrating said aperatures.

8. The invention according to claim 7 wherein rotary pressure rollers are arranged to cooperate with said rotatable feed rollers in holding and positioning said workpiece relative to said workpiece supporting plate.

9. The invention according to claim 8 wherein lifting and pressing means carried by said support means are provided for pressing said pressure rollers against said feed rollers.

10. An automatically operated sewing apparatus comprising:

a sewing machine having a work supporting surface and stitch forming instrumentalities adapted to operate along divergent edges of a workpiece;

a control system for sequentially operating said sewing machine to sew at least three sides of a workpiece;

independent driving means for positioning and holding the workpiece on said work supporting surface;

a movable support means responsive to the control system for removing the workpiece from the sewing machine area and transfering same to a predetermined position including means for holding the removed workpiece on the support means during transferance; and operative means interconnected with said movable support means for feeding the workpiece held on said support means into a predetermined position relative to said support means prior to its deposit at said predetermined position.

11. The invention according to claim 10 wherein said movable support means includes a work supporting surface onto which the workpiece passes from said sewing machine.

12. The invention according to claim 11 wherein said supporting surface is provided with recesses and said operative means includes driven feeding means penetrating said recesses.

13. The invention according to claim 12 wherein said feeding means include at least two roller means rotatably driven from an independently controlled drive source.

14. The invention according to claim 13 wherein said drive source may be preadjusted to rotate said roller means as a function of workpiece size.

15. The invention according to claim 13 wherein said roller means are carried on a revoluable shaft arranged on one side of the movable support means work supporting surface and said holding means include rotational pressure rollers arranged on the opposite side of said work supporting surface.

16. The invention according to claim 15 wherein lifting and pressing means are provided for pressing said presser rollers against said feed rollers.

17. The invention according to claim 10 wherein said positioning means includes a feed wheel movable toward and away from said work supporting surface.

18. The invention according to claim 17 wherein said feed wheel is adjustably mounted above to the work supporting surface of said sewing machine.

* * * * *